US005941524A

United States Patent [19]

Chang

[11] Patent Number: 5,941,524

[45] Date of Patent: Aug. 24, 1999

[54] BALL GAME

[76] Inventor: Ching-Chao Chang, No.202-1,Tachou Rd., Shen Kang Village, Taichung County, Taiwan

[21] Appl. No.: 09/136,700

[22] Filed: Aug. 19, 1998

[51] Int. Cl.[6] ..... A63F 7/04

[52] U.S. Cl. ..... 273/123 R

[58] Field of Search ..... 273/108, 118 R, 273/123 R

[56] References Cited

U.S. PATENT DOCUMENTS

| | | | |
|---|---|---|---|
| 669,826 | 3/1901 | Floyd | 273/108 |
| 1,567,966 | 12/1925 | McKenzie | 273/108 |
| 3,100,643 | 8/1963 | Almashy | 273/123 R |
| 4,385,763 | 5/1983 | Moscovich | 273/123 R |

*Primary Examiner*—Raleigh W. Chiu
*Attorney, Agent, or Firm*—Pro-Techtor International Services

[57] ABSTRACT

A ball game, comprising: a base plate, having a depression, surrounded by a periphery with an inner side, into which a groove is cut; a cardboard plate, inserted into the depression of the base plate and having a plurality of target spots with at least two colors; a transparent plate, put on the cardboard plate and having a plurality of holes, which are arranged to fit on the target spots of the cardboard plate; a plurality of balls; and a cover, put on the upper side of the base plate; wherein, by the plurality of target spots in conjunction with the plurality of holes, targets of various colors for the balls are provided for playing with more fun.

3 Claims, 5 Drawing Sheets

BALL GAME

BACKGROUND OF THE INVENTION

1. Field of the Invention

The present invention relates to a ball game, particularly to a ball game with balls of at least two colors.

2. Description of Related Art

A conventional ball game basically has a plate with a central depressed part, into which a plurality of holes are carved. The holes are sized to accommodate balls. The balls all have the same color. For playing the ball game, players roll balls on the plate by inclining the plate in various directions, trying to fill all the holes with the balls. Once all holes are filled, the game is over. Though interesting at first, after some practice the ball game becomes easy to play and thus boring.

SUMMARY OF THE INVENTION

It is therefore the object of the present invention to provide a ball game with balls of at least two colors.

Another object of the present invention is to provide a ball game which is challenging to play.

DETAILED DESCRIPTION OF THE PREFERRED EMBODIMENTS

Figure 1:
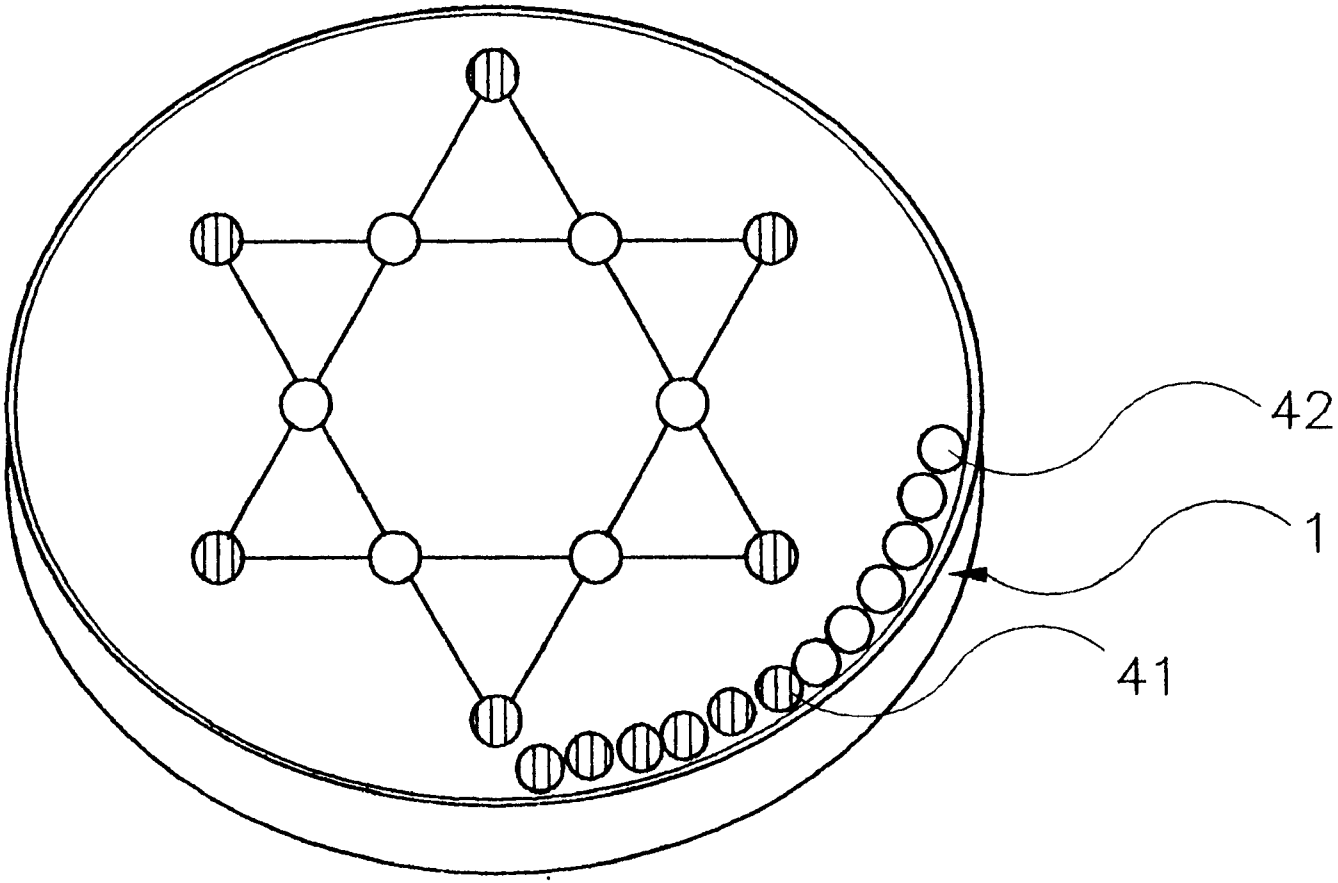
FIG. 1 is a perspective view of the ball game of the present invention.
Figure 2:
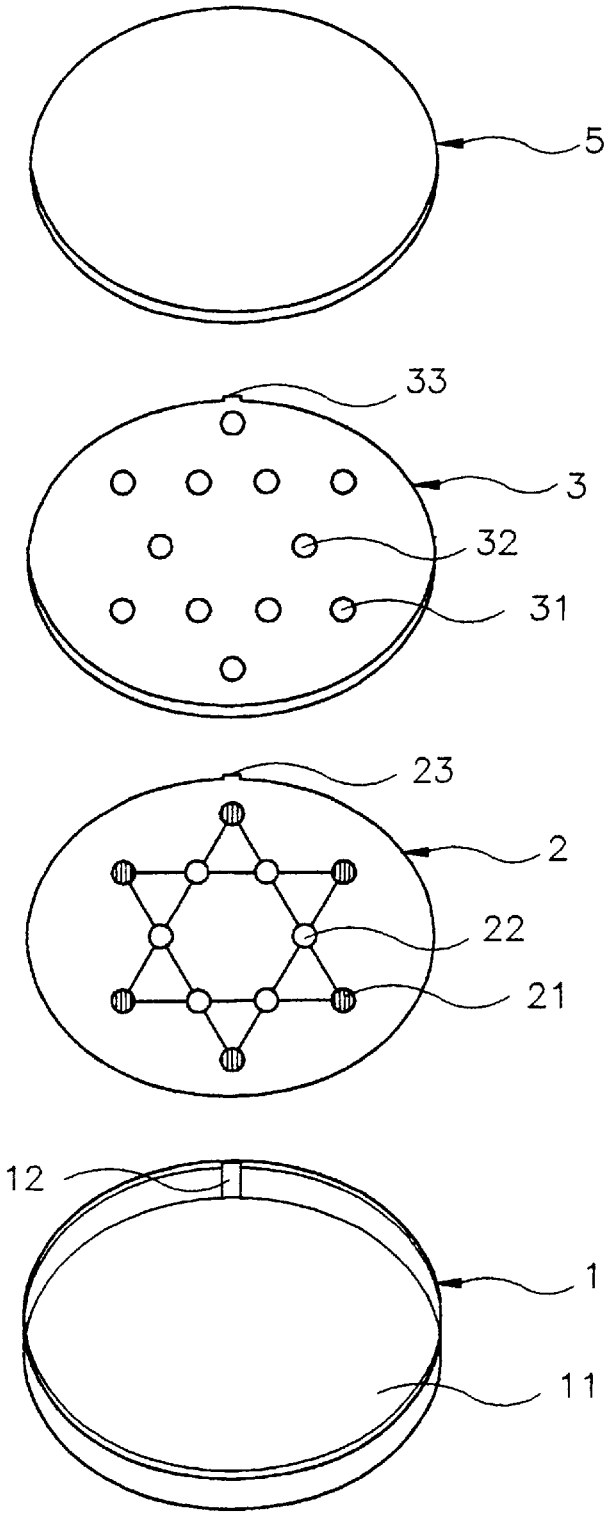
FIG. 2 is an exploded view of the ball game of the present invention.

As shown in FIGS. 1 and 2, the ball game of the present invention comprises a base plate 1; a cardboard plate 2; a transparent plate 3; a plurality of balls 41, 42; and a cover 5. The base plate 1 has an upper side, a lower side, a central depression 11 and a periphery, which surrounds the central depression 11.

The cardboard plate 2 is inserted in the depression 11 of the base plate 1, having a shape that fits therein. A plurality of target spots 21, 22 of two sorts are marked on the cardboard plate 2. As shown in FIG. 1, the target spots 21, 22 sit on the corners of a star and on intersections of lines connecting the corners of the star. Other arrangements may also be implemented. In the following explanation, an arrangement of the target spots 21, 22 on a star is taken as an example.

Referring again to FIGS. 1 and 2, the target spots 21 are located on the corners of the star, whereas the target spots 22 sit on the intersections of lines connecting the corners of the star.

The transparent plate 3 is laid on the cardboard plate 2. The transparent plate 3 has a plurality of holes 31, 32, wherein the holes 31 are located above the target spots 21 and the holes 32 are located above the target spots 22. Thus, with the ball game of the present invention assembled, a plurality of colored holes is visible.

The balls 41, 42 have two colors, e.g., the balls 41 are red and the balls 42 are white. Players of the ball game roll the balls by inclining the transparent plate 3, trying to have the balls 41, 42 fill the holes 31, 32 above the target spots 21, 22.

In the present invention, the target spots 21, 22 as well as the balls 41, 42 are made of at least two colors. Balls and target spots of at least two sizes may be implemented, too.

The cover 5 is made of transparent material and is set on the upper side of the base plate 1. For increased stability, the base plate 1 has a vertical groove 12 in the periphery thereof, and the cardboard plate 2 has a peripheral, outward extending projection 23, which fits into the groove 12. Furthermore, the transparent plate 3 has a peripheral, outward extending projection 33, which also fits into the groove 12. After inserting the projections 23 and 33 into the groove 12, the cardboard plate 2 and the transparent plate 3 are blocked from rotating within the base plate 1, such that the target spots 21, 22 and the holes 31, 32 will not change positions.

Figure 3:
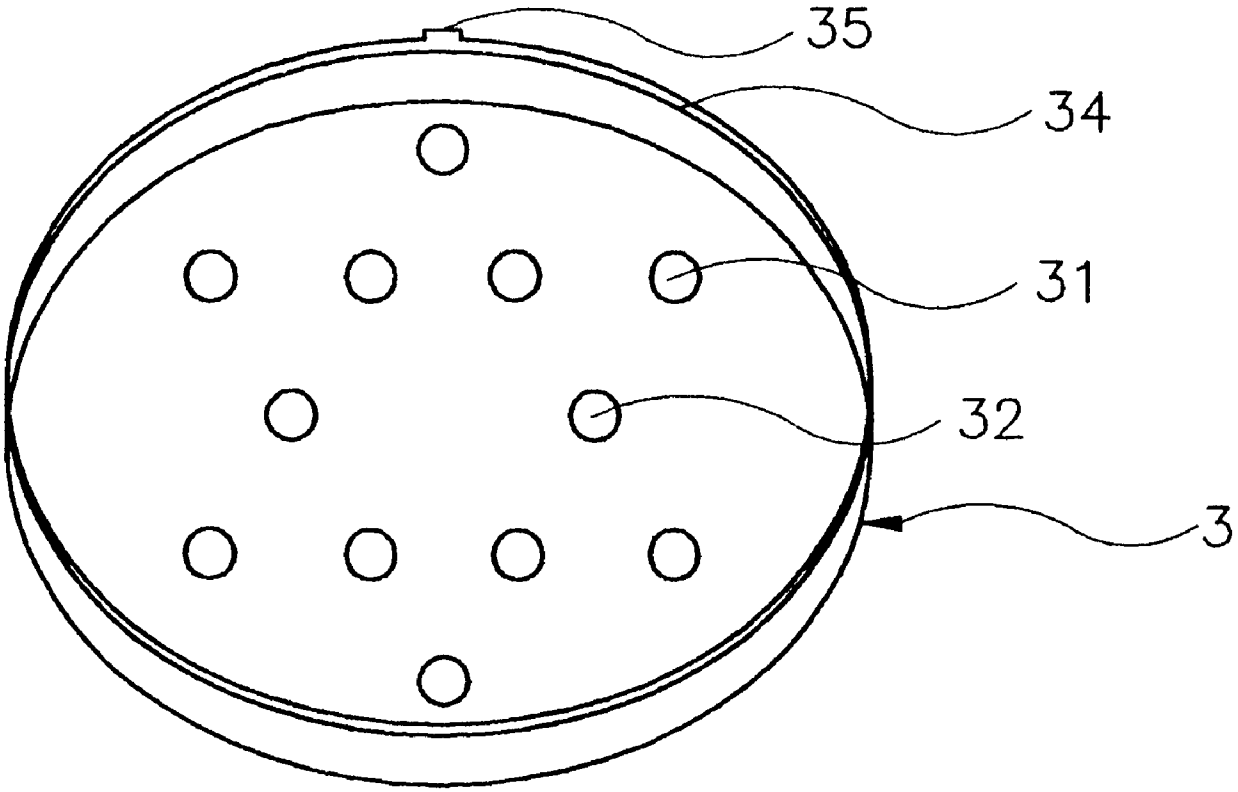
FIG. 3 is a perspective view of the transparent plate of the present invention in the second embodiment.

Referring to FIG. 3, in a second embodiment of the ball game of the present invention, the transparent plate 3 has a peripheral ring 34, from which a projection 35 extends outwards.

Figure 4:
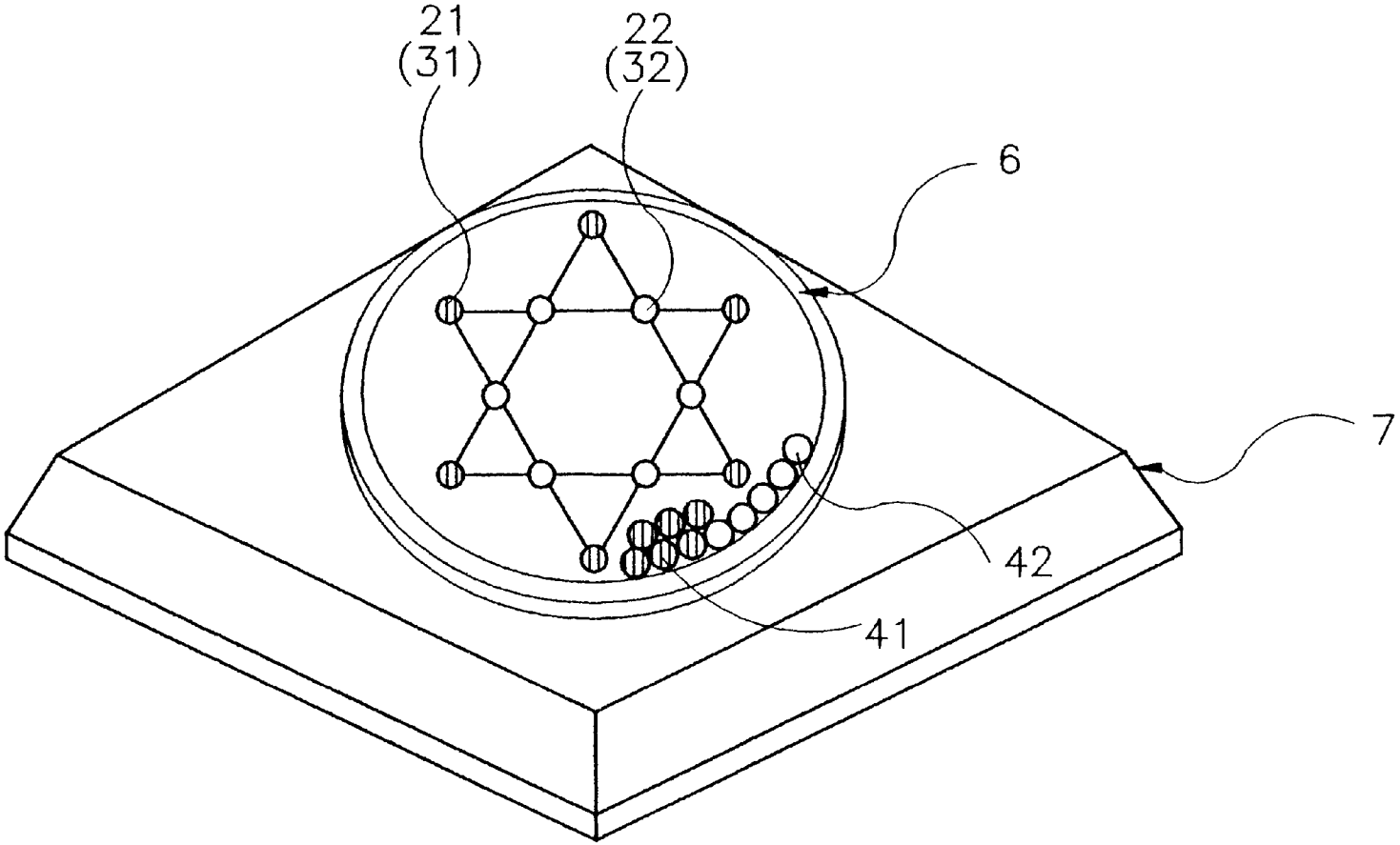
FIG. 4 is a perspective view of the present invention in the third embodiment, which has a base.
Figure 5:
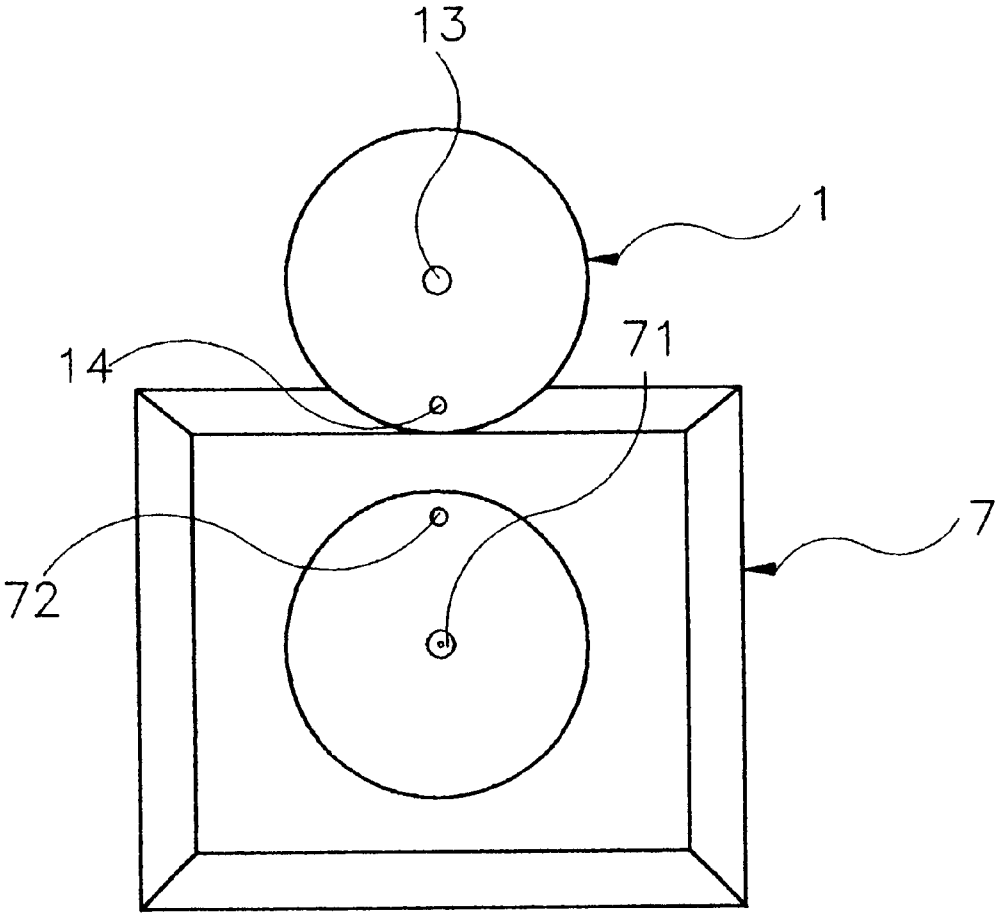
FIG. 5 is a bottom view of the present invention in the third embodiment, showing the projections on the base plate and the depressions on the base.

Referring to FIG. 4, in a third embodiment of the ball game of the present invention, for a good look the cover 5 is fixed on the base plate 1, surrounded by a decorative metal ring 6. Furthermore the base plate 1 is mounted on a base 7. As shown in FIG. 5, for mounting the base plate 1 on a base 7, the base plate 1 has on the lower side thereof at least two projections 13, 14, which fit into depressions 71, 72 on the base 7. Additionally, the base has a large depression 73 for accommodating the base plate 1.

The cardboard plate 2 of the present invention provides clearly visible targets for the balls. With the holes in the transparent plate 3 a nice, three-dimensional view of the targets is given, making the present invention a decorative object as well as a game. Various colors of the targets and of the balls allow interesting variations of games, e.g., bringing red balls into red targets and white balls into white targets, marking certain holes as targets while excluding others etc. Thus the ball game of the present invention provides further challenges and adds to the fun of playing.

While the invention has been described with reference to preferred embodiments thereof, it is to be understood that modifications or variations may be easily made without departing from the spirit of this invention which is defined by the appended claims.

I claim:

1. A ball game, comprising:

a base plate, having an upper side, a depression, surrounded by a periphery with an inner side, into which a groove is cut;

a cardboard plate, inserted from said upper side of said base plate into said depression and having a plurality of target spots with at least two colors;

a transparent plate, inserted from said upper side of said base plate into said depression on said cardboard plate and having a plurality of holes, which are arranged to fit on said target spots of said cardboard plate;

a plurality of balls; and a cover, put on said upper side of said base plate;

wherein, by said plurality of target spots in conjunction with said plurality of holes, targets of various colors for said balls are provided for playing with more fun.

2. A ball game according to claim 1, wherein said cardboard plate has an outward projection fitting into said groove of said base plate for stable positioning of said cardboard plate.

3. A ball game according to claim 1, wherein said transparent plate has an outward projection fitting into said groove of said base plate for stable positioning of said transparent plate.

* * * * *